US011454420B2

(12) United States Patent
Hoyt et al.

(10) Patent No.: US 11,454,420 B2
(45) Date of Patent: Sep. 27, 2022

(54) SERVICE PLATE FOR A HEAT EXCHANGER ASSEMBLY

(71) Applicant: Johnson Controls Technology Company, Auburn Hills, MI (US)

(72) Inventors: Bennie D. Hoyt, Benton, KS (US); Brian D. Rigg, Douglass, KS (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 432 days.

(21) Appl. No.: 16/282,940

(22) Filed: Feb. 22, 2019

(65) Prior Publication Data

US 2020/0248929 A1 Aug. 6, 2020

Related U.S. Application Data

(60) Provisional application No. 62/801,935, filed on Feb. 6, 2019.

(51) Int. Cl.
*F24F 13/32* (2006.01)
*F25B 39/02* (2006.01)
(Continued)

(52) U.S. Cl.
CPC ..... *F24F 13/32* (2013.01); *F24F 1/16* (2013.01); *F24F 1/18* (2013.01); *F24F 13/30* (2013.01); *F25B 39/022* (2013.01)

(58) Field of Classification Search
CPC .... F24F 1/16; F24F 1/18; F24F 1/0053; F24F 1/0059; F24F 1/0063; F24F 1/0067; F24F 1/00077; F24F 1/0323; F24F 1/0325; F24F 1/02; F24F 13/082; F24F 13/084; F24F 13/30; F24F 13/32; F25B 39/022; F25B 39/02; F28D 1/0426; F28D 1/0477; F28D 2001/0266; F28D 2001/028; F28D 2021/0035; F28F 9/001; F28F 9/002; F28F 9/0268; F28F 2009/226; F28F 2280/02;
(Continued)

(56) References Cited

U.S. PATENT DOCUMENTS 2,750,211 A * 6/1956 Curtis ..... F16L 9/003 285/399
3,097,507 A * 7/1963 Maakuh ..... F25B 39/02 62/285
(Continued)

FOREIGN PATENT DOCUMENTS

KR 20060098282 A 9/2006
KR 20090022640 A 3/2009
(Continued)

*Primary Examiner* — Jianying C Atkisson
*Assistant Examiner* — Jose O Class-Quinones
(74) *Attorney, Agent, or Firm* — Fletcher Yoder, P.C.

(57) ABSTRACT

A heat exchanger assembly includes a first heat exchanger plate and a second heat exchanger plate each include an outer boundary edge. The heat exchanger assembly also includes a service plate configured to be coupled to the outer boundary edge of each of the first and second heat exchanger plates. The service plate includes multiple sections coupled together to form a single plate, wherein each section of the multiple sections is configured to be individually removed to provide access to a space between the first and second exchanger plates.

27 Claims, 6 Drawing Sheets

(51) Int. Cl.
*F24F 1/18* (2011.01)
*F24F 1/16* (2011.01)
*F24F 13/30* (2006.01)

(58) Field of Classification Search
CPC .... B21D 39/03; B21D 39/031; B21D 39/034; B21D 39/035; B21D 39/037
See application file for complete search history.

(56) References Cited

U.S. PATENT DOCUMENTS 3,836,052 A * 9/1974 Chopieska ..... A01B 69/022 222/611.1
4,149,588 A * 4/1979 Waters ..... F28D 15/0275 165/11.1
4,461,345 A * 7/1984 Vandervaart ..... F24D 11/02 165/113
4,470,271 A * 9/1984 Draper ..... F24F 1/16 165/124
4,619,315 A * 10/1986 Waryasz ..... B01J 8/1836 122/4 D
4,691,531 A * 9/1987 Clifton ..... F24F 3/00 62/263
4,860,918 A * 8/1989 Wuyten ..... E04H 1/1238 220/668
5,279,360 A * 1/1994 Hughes ..... F25B 39/02 165/111
5,613,554 A * 3/1997 Bull ..... F24F 13/22 165/122
6,276,443 B1 * 8/2001 Martin, Sr. ..... F28D 1/0477 165/124
6,539,727 B1 * 4/2003 Burnett ..... F24F 3/16 62/264
6,782,708 B1 8/2004 Boer
6,978,909 B2 * 12/2005 Goetzinger ..... F24F 13/222 220/571
7,065,978 B2 6/2006 Hong
7,174,741 B2 2/2007 Lee
7,263,850 B2 * 9/2007 Eom ..... F24F 1/0007 62/286
7,370,489 B2 * 5/2008 Rios ..... F24F 13/222 62/285
7,418,826 B2 * 9/2008 Rios ..... F24F 13/222 62/285
7,757,510 B2 7/2010 Rosete
7,793,514 B2 * 9/2010 Rios ..... F28F 17/005 62/285
8,166,776 B2 * 5/2012 Kopko ..... F28F 27/02 62/513
8,286,445 B2 10/2012 Park
8,360,834 B1 1/2013 Semmes
8,844,306 B2 * 9/2014 De La Cruz ..... F25B 40/02 62/285
8,939,524 B2 1/2015 Gasser
9,188,372 B2 11/2015 Thomas
9,200,812 B2 12/2015 Narikawa
9,279,620 B2 * 3/2016 Edens ..... F28F 1/32
9,303,882 B2 * 4/2016 Hancock ..... F24H 3/022
9,335,098 B2 5/2016 Pawlick
9,410,716 B2 8/2016 Ryu
9,726,388 B2 8/2017 Goel
9,869,487 B2 * 1/2018 Nickey ..... F28D 1/0435
10,113,816 B2 10/2018 Akiyoshi
10,151,507 B2 12/2018 Santini
2005/0109053 A1 * 5/2005 Eom ..... F24F 1/0007 62/285
2006/0213157 A1 9/2006 Kalous
2007/0169493 A1 * 7/2007 Rios ..... F24F 13/222 62/285
2007/0169498 A1 * 7/2007 Rios ..... F28F 17/005 62/285
2007/0173110 A1 7/2007 Heberer
2007/0193725 A1 * 8/2007 Coy ..... F28B 1/06 165/124
2007/0227172 A1 10/2007 Fukumura
2008/0148746 A1 * 6/2008 Yanik ..... F25B 39/00 62/115
2008/0160902 A1 * 7/2008 Desler ..... F24F 1/0033 454/251
2010/0162739 A1 * 7/2010 Kopko ..... F25D 23/00 62/115
2011/0016903 A1 * 1/2011 Ballet ..... F24F 13/222 62/276
2011/0126559 A1 * 6/2011 Kopko ..... F25B 49/02 62/79
2011/0253341 A1 * 10/2011 Al-Otaibi ..... F28F 9/22 165/69
2012/0018117 A1 * 1/2012 Yamada ..... F24F 13/30 165/11.1
2012/0031139 A1 * 2/2012 Shirota ..... F24F 1/0029 62/426
2012/0125033 A1 * 5/2012 Tanno ..... F28B 1/06 62/324.1
2015/0034290 A1 2/2015 Mercer
2016/0084266 A1 * 3/2016 Showole ..... F24F 13/32 165/122
2016/0102873 A1 * 4/2016 Harris ..... F24F 3/001 165/217
2017/0059188 A1 * 3/2017 Hancock ..... F25B 13/00
2017/0130974 A1 * 5/2017 Mercer ..... F24F 1/16
2017/0159967 A1 * 6/2017 Kawanori ..... F24F 13/222
2017/0205147 A1 * 7/2017 Rizzi ..... F28F 9/0241
2018/0027762 A1 2/2018 Brodeur
2018/0080667 A1 * 3/2018 Nishimoto ..... F25B 1/00
2018/0340706 A1 11/2018 Amick

FOREIGN PATENT DOCUMENTS

WO 1999001702 A1 1/1999
WO 2018053860 A1 3/2018

* cited by examiner

SERVICE PLATE FOR A HEAT EXCHANGER ASSEMBLY

CROSS REFERENCE TO RELATED APPLICATIONS

This application claims priority from and the benefit of U.S. Provisional Application Ser. No. 62/801,935, entitled "SERVICE PLATE FOR A HEAT EXCHANGER ASSEMBLY," filed Feb. 6, 2019, which is hereby incorporated by reference in its entirety for all purposes.

BACKGROUND

The present disclosure relates generally to heating, ventilation, and/or air conditioning (HVAC) systems, and specifically, relates to service plate for a heat exchanger assembly (e.g., evaporator coil assembly).

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to and ventilated from the environment. For example, a HVAC system may use a heat exchanger to place the air flow in thermal communication with a refrigerant directed through the heat exchanger. Sometimes the heat exchanger may include walls coupled to a frame of the heat exchanger that keep the space within the heat exchanger from being readily serviced. In order to service the heat exchanger, the entire heat exchanger and/or other components of the HVAC system (e.g., return duct) may have to be removed, which is both labor intensive and costly.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat exchanger assembly for an air handling unit is provided. The heat exchanger assembly includes a first heat exchanger plate and a second heat exchanger plate each include an outer boundary edge. The heat exchanger assembly also includes a service plate configured to be coupled to the outer boundary edge of each of the first and second heat exchanger plates. The service plate includes multiple sections coupled together to form a single plate, wherein each section of the multiple sections is configured to be individually removed to provide access to a space between the first and second heat exchanger plates.

In another embodiment, a service plate for a heat exchanger assembly of an air handling unit is provided. The service plate includes multiple sections coupled together to form a single plate, wherein each section of the multiple sections is configured to be individually removed to provide access to a space between a first heat exchanger plate and a second heat exchanger plate. The first exchanger plate and the second heat exchanger plate each include an outer boundary edge. The service plate is configured to be coupled to the outer boundary edge of each of the first and second heat exchanger plates.

In a further embodiment, an air handling unit is provided. The air handling unit includes an A-shaped evaporator coil assembly having a first longitudinal end and a second longitudinal end. The air handling unit also includes a service plate configured to be coupled to either the first longitudinal end or the second longitudinal end. The service plate includes multiple sections coupled together to form a single plate, wherein each section of the multiple sections is configured to be individually removed to provide access to a space within the A-shaped evaporator coil assembly.

DRAWINGS

Various aspects of this disclosure may be better understood upon reading the following detailed description and upon reference to the drawings in which.

DETAILED DESCRIPTION

Figure 1:
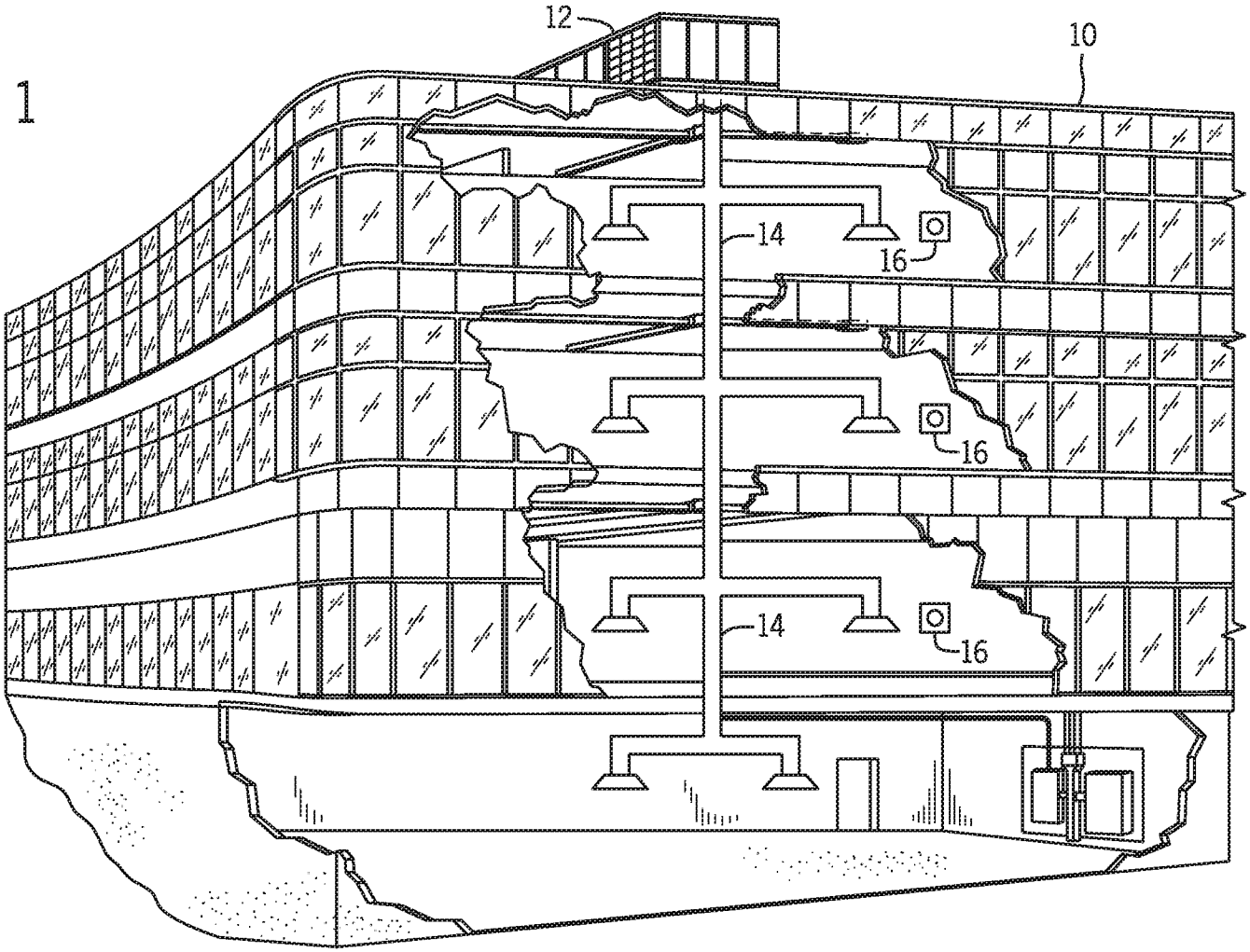
FIG. 1 is a schematic of an embodiment of an environmental control system for building environmental management that may employ one or more HVAC units, in accordance with an aspect of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to a service plate for a heat exchanger assembly (e.g., an evaporator coil such as an A-shaped evaporator coil) for a heating, ventilation, and/or air conditioning (HVAC) system. The heat exchanger assembly may include a couple of heat exchanger plates or slabs that converge toward each other to form an A-shaped assembly. The heat exchanger assembly may be oriented in a vertical orientation or a horizontal orientation (e.g. relative to air flow). A first service plate may be coupled to a first longitudinal end (e.g., front) of the heat exchanger assembly and a second service plate coupled to a second longitudinal end (e.g., rear) opposite the first longitudinal end between the heat exchanger plates. Each service plate may include a plurality of sections coupled together to form a single plate. Removal of one or more of the sections provides access to a space between the heat exchanger plates for servicing of the heat exchanger assembly. The ability to remove one or more sections enables the technician to adjust the amount of accessible space. In certain embodiments, the service plate may include a triangular shape that corresponds to the A-shaped heat exchanger assembly. One or more of the sections of the service plate may overlap with an adjacent section. The adjacent sections may be coupled via a fastener through the overlapped portion. This coupling of the sections may ensure the air flow flows through the heat exchanger plates instead of between the sections of the service plate and outside the heat exchanger assembly. The service plate enables access to the space within the heat exchanger assembly without having to remove the heat exchanger assembly and/or other components (e.g., return duct) of the HVAC system, which simplifies the servicing or maintenance of the HVAC system and minimizes the labor time.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
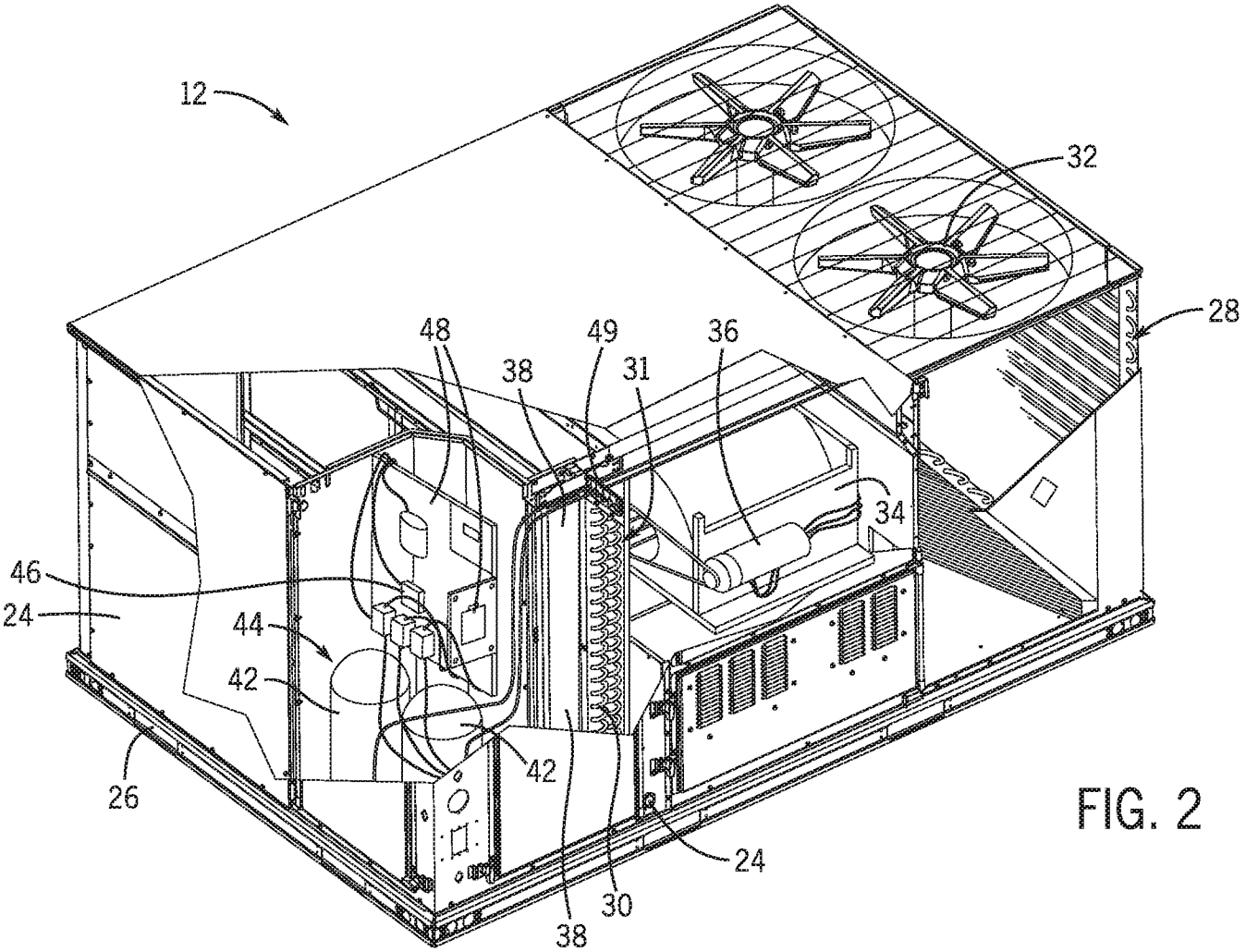
FIG. 2 is a perspective view of an embodiment of a packaged HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
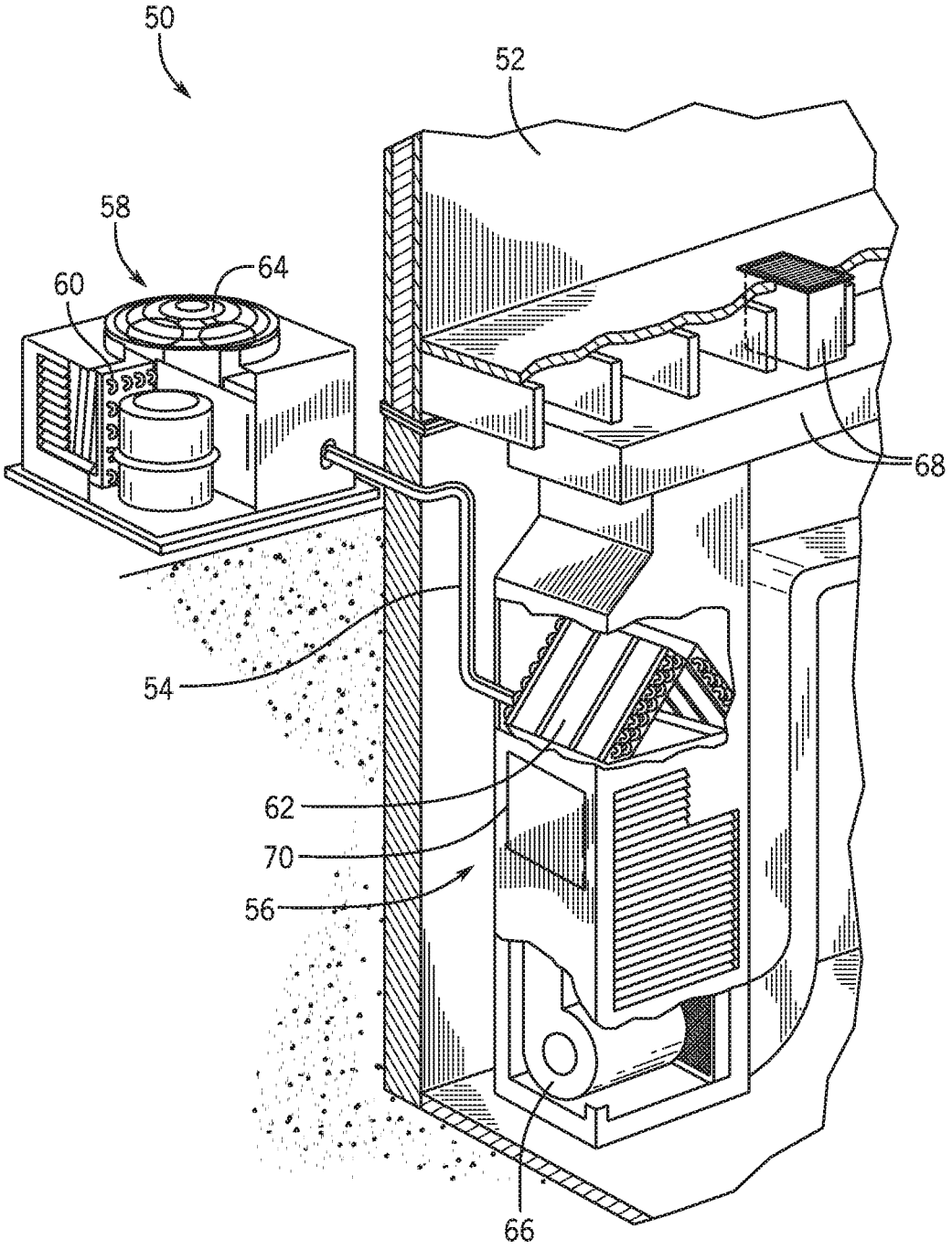
FIG. 3 is a schematic of an embodiment of a residential, split heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
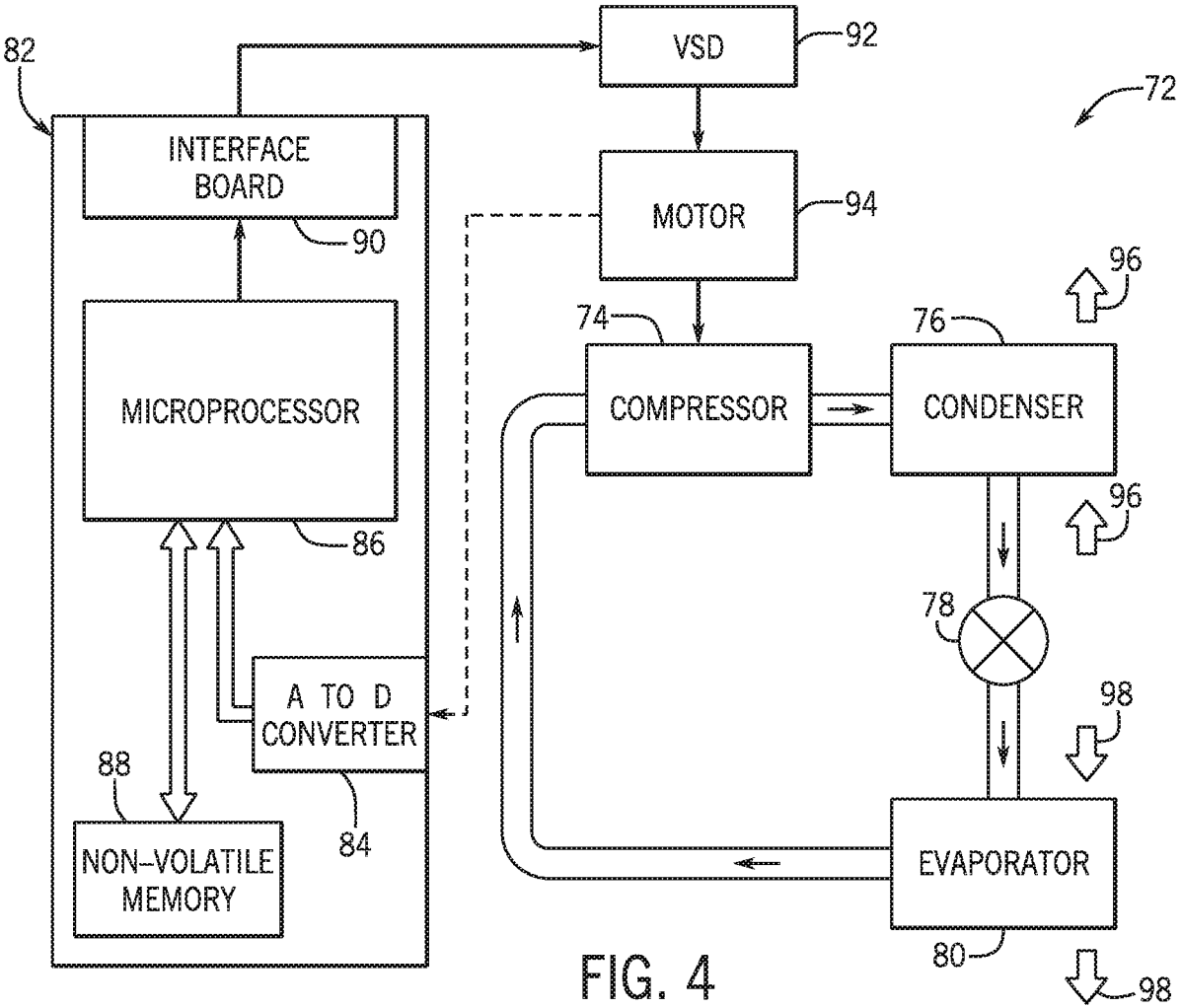
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
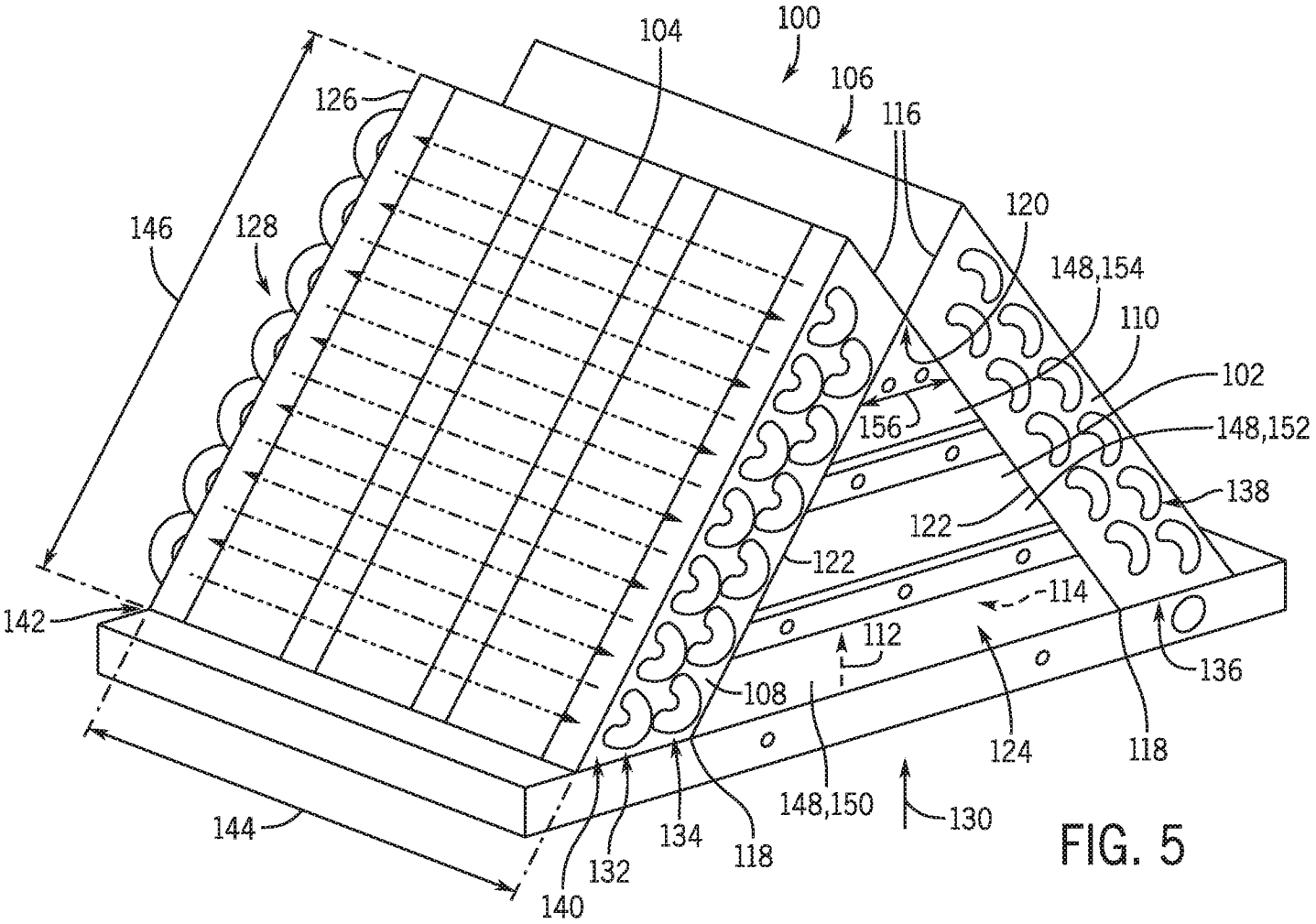
FIG. 5 is a perspective view of an embodiment of a heat exchanger assembly having service plates, in accordance with an aspect of the present disclosure.

FIG. 5 is perspective view of an embodiment of a heat exchanger assembly 100 (e.g., coil assembly) having service plates 102. As similarly discussed above, the heat exchanger assembly 100 may operate as an evaporator when the HVAC system is operating as an air conditioner, and the heat exchanger assembly 100 may operate as a condenser when the HVAC system is operating as a heat pump. Additionally, the heat exchanger assembly 100 receives and directs one or multiple flows of a refrigerant, or working fluid, therein. It should be appreciated that the heat exchanger assembly 100 may be any of the heat exchangers discussed above or any other suitable heat exchanger configured to receive a working fluid flow.

As shown, the heat exchanger assembly 100 includes multiple coil passes 104 disposed within a frame 106. The frame 106 is an A-shaped frame, but other suitably shaped frames, such as M-shaped frames, N-shaped frames, among others, may be employed with the techniques disclosed herein. In some embodiments, the frame 106 includes sheets or fins that retain the multiple coil passes 104 in an operating position. Additionally, the frame 106 may include a first frame portion 108 (e.g., heat exchanger plate or slab) coupled to a second frame portion 110 (e.g., heat exchanger plate or slab). The first and second frame portions 108, 110 may be angled relative to one another or converge toward each other, such that an air flow 112 may be drawn through an open space 114 within the first and second frame portions 108, 110 (and service plates 102) and across the multiple coil passes 104. The air flow 112 may be drawn or pushed along one or more corresponding air flow paths through and/or across the coil passes 104. In some embodiments, the heat exchanger assembly 100 may be oriented in another direction, such that down flow or side flow (e.g., horizontal) configurations, instead of the illustrated up flow configuration, are achieved. As depicted, each frame portion 108, 110 includes an edge or end 116 (e.g., upper edge or end) and an edge or end 118 (e.g., lower edge or end). The edges 116, 118 are separated by the edges 122 (e.g., in a front 124 of the frame 106) and edges 126 (e.g., in a rear 128 of the frame 106). The frame portions 108, 110 converge toward each other in a direction 130 from the edges 118 toward the edges 116 so that the edges 116 abut each other at an apex 120 of the frame 106.

Looking to more details of the flow of the refrigerant within the heat exchanger assembly 100, the coil passes 104 may be divided between multiple parallel circuits. For example, the heat exchanger assembly 100 of the present embodiment includes two parallel circuits for each frame portion 108, 110. That is, a first parallel circuit 132 may extend along an outer portion of the first frame portion 108 and a second parallel circuit 134 may extend along an inner portion of the first frame portion 108. Additionally, a third parallel circuit 136 may extend along an inner portion of the second frame portion 110, and a fourth parallel circuit 138 may extend along an outer portion of the second frame portion 110. The inner portions of the frame portions 108, 110 face toward one another, while the outer portions of the frame portions 108, 110 face away from one another. Each parallel circuit 132, 134, 136, 138 may wind back and forth within the heat exchanger assembly 100. For example, the parallel circuits 132, 134, 136, 138 may include the multiple coil passes 104 that extend from a first longitudinal end 140 (e.g., adjacent the front 124) of the heat exchanger assembly 100 to a second longitudinal end 142 (e.g., adjacent the rear 128) of the heat exchanger assembly 100 and from the upper end 116 of the heat exchanger assembly 100 to the lower end 118 of the heat exchanger assembly 100. By winding through a length 144 defined between the longitudinal ends 140, 142 and a height 146 or slanted height of the heat exchanger assembly 100 defined between the ends 116, 118 of the heat exchanger assembly 100, the parallel circuits 132, 134, 136, 138 provide heat transfer surface area to enable the refrigerant to exchange heat with the air flow 112 traveling across the heat exchanger assembly 100. The heat exchanger assembly 100 may include any suitable number of parallel circuits, such as one, two, three, four, five, six, seven, eight, or more parallel circuits extending therethrough.

As depicted, the service plate 102 is coupled to the edges 122 (e.g., outer boundary edges) of the frame portions 108, 110 (e.g., at the front 124 or first longitudinal end 140). Similarly (not shown), another service plate 102 is coupled to edges 126 (e.g., outer boundary edges) of the frame portions 108, 110 (e.g., at the rear 128 or the second longitudinal end 142). Each service plate 102 includes a plurality of sections 148 that are coupled together to form a single, solid plate. The service plates 102 may be made of metal, plastic, a composite, or a combination thereof. The service plates 102 ensure the air flow 112 flows through the space 114 into the frame portion 104, 106 instead of outside the heat exchanger assembly 100 (e.g., at the front 124 or rear 128). As depicted, each service plate 102 includes three sections 150, 152, 154. The number of sections 148 may vary (2, 3, 4, 5, 6, or more sections 148). Each section 148 is configured to be individually removed to provide access to the space 114 between the frame portions 108, 110 for servicing of the interior of the heat exchanger assembly 100. As a result, an amount of the space 114 that is accessible for servicing is adjustable depending on the number of sections 148 of the service plate 102 removed. In certain embodiments, tubing may be disposed in front of an outer surface of the service plate 102 that would make it difficult to remove a service plate made of a single piece from the heat exchanger assembly 100, while the service plate 102 may be removed in sections 148. As depicted, a width 156 (or longitudinal length) of the sections 148 decreases in the direction 130 and the service plate 102 has a triangular shape. In addition, the sections 148 are disposed horizontally (e.g., perpendicular to the direction 130). In certain embodiments, the sections 148 may be disposed vertically (e.g., parallel to the direction 130). In certain embodiments, the service plates 102 may vary in shape depending on the shape of the frame 106. In certain embodiments, the number of service plates 102 on a respective longitudinal end 140, 142 may vary depending on the shape of the frame 106. For example, with an N-shaped frame, each longitudinal end 140, 142 may include two service plates orientated in opposite direction from each other between the respective frame portions. With an M-shaped frame, each longitudinal end 140, 142 may include three services plates within the middle service plate orientated in an opposite direction from the two outer service plates.

Figure 6:
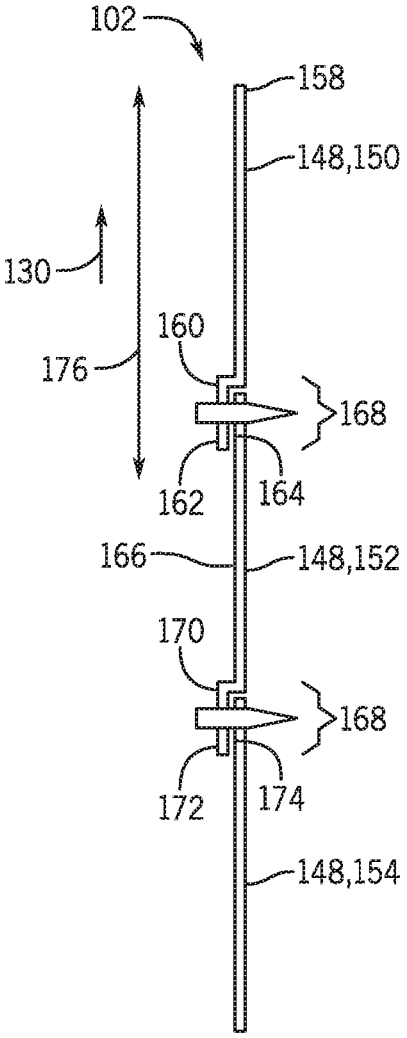
FIG. 6 is a side view of an embodiment of the service plate of FIG. 5, in accordance with an aspect of the present disclosure.

FIG. 6 illustrates how the sections 148 of each service plate 102 are coupled together. Each section 148 includes an end 158 (e.g., upper end) and an end 160 (e.g., lower end) opposite the end 158. Each lower end 160 includes a lip 162 (except the bottom section 154 of the service plate 102) that has an inner surface 164 that overlaps an outer surface 166 of an upper end 158 of the adjacent section 148 to form an overlapped portion 168. A fastener 170 (e.g., a screw) is disposed through respective openings 172, 174 of the lip 162 and the upper end 158 that are aligned with each other. Multiple fasteners 170 may be disposed through the sections 148 in each overlapped region 168. The fasteners 170 couple the adjacent sections 148 together to form the single service plate 102. Although gaps are depicted in FIG. 6, the ends 158, 160 and the surfaces 164, 166 of the sections 148 may abut or contact each other to form a solid plate when fastened together (via the fasteners 170) so that none of the air flow 112 escapes through the service plate 102. Each section 148 has a length 176 in the direction 130 from the lower end 160 to the upper end 158. In some embodiments, the length 176 of one or more sections 148 may vary from each other. In other embodiments, the length 176 of each section 148 may be the same.

Figure 7:
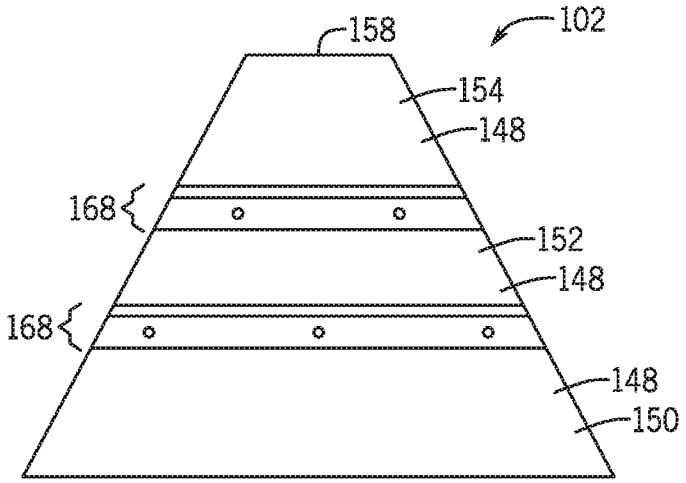
FIG. 7 is a front view of an embodiment of a service plate (e.g., having a truncated triangle shape), in accordance with an aspect of the present disclosure.
Figure 8:
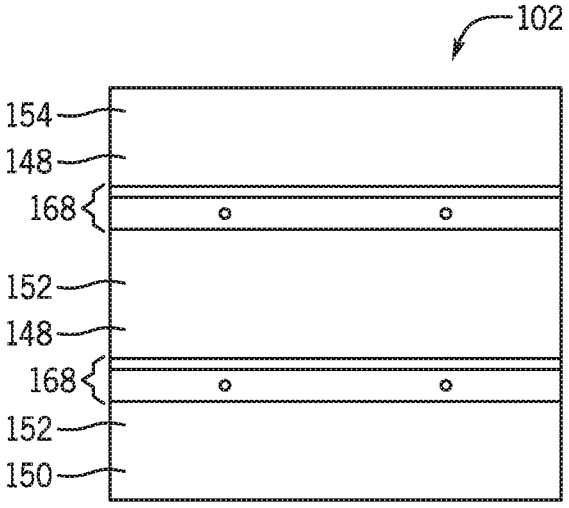
FIG. 8 is a front view of an embodiment of a service plate (e.g., having a square shape)

As mentioned above, the shape of the service plates 102 may vary depending on the shape of the frame 106 of the heat exchanger assembly 100. For example, FIG. 7 illustrates a truncated triangular-shaped service plate 102, where the upper end 158 of the section 154 is flat. FIG. 8 illustrates a square-shaped service plate 102, where each section 148 is rectilinear (e.g., rectangular). In certain embodiments, the service plate 102 may include a rectilinear shape such as a rectangle. The illustrated shapes of the service plate 102 are a few of the possible examples.

Figure 9:
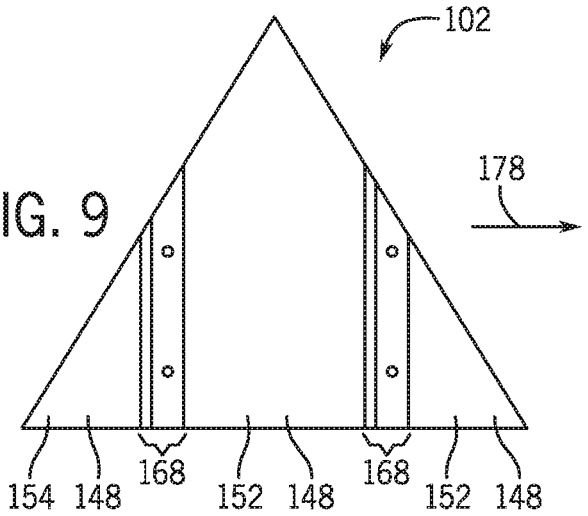
FIG. 9 is a front view of an embodiment of a service plate having vertically arranged sections.

Besides a different shape, the sections 148 of the service plates 102 may be orientated differently. In contrast to FIG. 5, FIG. 9 illustrates the sections 148 being orientated in a vertical direction as opposed to a horizontal direction. The sections 148 are coupled in similar manner to that described above except the adjacent regions 148 overlap in a horizontal direction 178 as opposed to a vertical direction (e.g., direction 130).

The service plate of the present disclosure may provide one or more technical effects useful in the servicing of a heat exchanger assembly of a HVAC system. For example, each service plate may be disposed between adjacent frame portions (e.g., heat exchangers slabs or plates) at longitudinal ends of the frame of the heat exchanger assembly. Each service plate may include a plurality of sections coupled together to form a single plate. Removal of one or more of the sections provides access to a space between the frame portions for servicing of the heat exchanger assembly. The ability to remove one or more sections enables the technician to adjust the amount of accessible space. One or more of the sections of the service plate may overlap with an adjacent section. The adjacent sections may be coupled via a fastener through the overlapped portion. This coupling of the sections may ensure the air flow flows through the frame portions instead of between the sections of the service plate and outside the heat exchanger assembly. The service plate enables access to the space within the heat exchanger assembly without having to remove the heat exchanger assembly and/or other components (e.g., return duct) of the HVAC system, which simplifies the servicing or maintenance of the HVAC system and minimizes the labor time. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger assembly for an air handling unit, comprising:

a first heat exchanger plate and a second heat exchanger plate each including an outer boundary edge; and at least one service plate configured to be coupled to the outer boundary edge of each of the first and second heat exchanger plates, wherein the service plate comprises a plurality of sections coupled together to form a single plate, wherein each section of the plurality of sections is configured to be individually removed without having to remove any of the other sections to provide access to a space between the first and second heat exchanger plates.

2. The heat exchanger assembly of claim 1, wherein the first heat exchanger plate and the second heat exchanger plate each include a first edge and a second edge disposed opposite the first edge, wherein the first and second edges are separated by third and fourth edges, wherein the first and second heat exchanger plates converge toward each other along the third and fourth edges in a direction from the first edge to the second edge, and the at least one service plate is configured to be coupled to either the third edges or the fourth edges of the first and second heat exchanger plates.

3. The heat exchanger assembly of claim 2, wherein the at least one service plate comprises a first service plate coupled to the third edges of the first and second heat exchanger plates and a second service plate coupled the fourth edges of the first and second heat exchanger plates.

4. The heat exchanger assembly of claim 3, wherein the third edges and the fourth edges are respectively located at a first longitudinal end and a second longitudinal end of the heat exchanger assembly.

5. The heat exchanger assembly of claim 2, wherein the at least one service plate decreases in width in the direction from the first edge to the second edge.

6. The heat exchanger assembly of claim 1, wherein an amount of the space that is accessible via removal of sections of the plurality of sections is adjustable.

7. The heat exchanger assembly of claim 1, wherein the at least one service plate comprises a triangular shape.

8. The heat exchanger assembly of claim 1, wherein the plurality of sections comprise three sections.

9. The heat exchanger assembly of claim 1, wherein adjacent sections of the plurality of sections are directly coupled to each other via fasteners extending through each of the adjacent sections.

10. The heat exchanger assembly of claim 1, wherein a section of the plurality of sections overlaps and directly contacts a portion of an adjacent section to keep air flow from escaping from the space through the at least one service plate.

11. The heat exchanger assembly of claim 10, wherein the section is coupled to the adjacent section via a fastener through the overlapped portion.

12. The heat exchanger assembly of claim 1, wherein the heat exchanger assembly comprises an evaporator.

13. A service plate for a heat exchanger assembly of an air handling unit, comprising:

a plurality of sections coupled together to form a single plate, wherein each section of the plurality of sections is configured to be individually removed without having to remove any of the other sections to provide access to a space between a first heat exchanger plate and a second heat exchanger plate, wherein the first exchanger plate and the second heat exchanger plate each include an outer boundary edge; and wherein the service plate is configured to be coupled to the outer boundary edge of each of the first and second heat exchanger plates.

14. The service plate of claim 13, wherein the service plate is configured to be coupled to a longitudinal end of the heat exchanger assembly.

15. The service plate of claim 13, wherein an amount of the space that is accessible via removal of sections of the plurality of sections is adjustable.

16. The service plate of claim 13, wherein the service plate comprises a triangular shape.

17. The service plate of claim 13, wherein adjacent sections of the plurality of sections are directly coupled to each other via fasteners extending through each of the adjacent sections.

18. The service plate of claim 13, wherein a section of the plurality of sections overlaps and directly contacts a portion of an adjacent section to keep air flow from escaping from the space through the service plate.

19. The service plate of claim 18, wherein the section is coupled to the adjacent section via a fastener through the overlapped portion.

20. The service plate of claim 13, wherein each section of the plurality of sections is orientated in a vertical direction.

21. An air handling unit, comprising:

an A-shaped evaporator coil assembly having a first longitudinal end and a second longitudinal end; and at least one service plate configured to be coupled to either the first longitudinal end or the second longitudinal end, wherein the at least one service plate comprises a plurality of sections coupled together to form a single plate, wherein each section of the plurality of sections is configured to be individually removed without having to remove any of the other sections to provide access to a space within the A-shaped evaporator coil assembly.

22. The air handling unit of claim 21, wherein the at least one service plate comprises a first service plate coupled to the first longitudinal end and a second service plate coupled to the second longitudinal end.

23. The air handling unit of claim 21, wherein an amount of the space that is accessible via removal of sections of the plurality of sections is adjustable.

24. The air handling unit of claim 21, wherein the at least one service plate comprises a triangular shape.

25. The air handling unit of claim 21, wherein the plurality of sections comprise three sections.

26. The air handling unit of claim 21, wherein adjacent sections of the plurality of sections are directly coupled to each other via fasteners extending through each of the adjacent sections.

27. The air handling unit of claim 21, wherein a section of the plurality of sections overlaps and directly contacts a portion of an adjacent section to keep air flow from escaping from the space through the at least one service plate, and the section is coupled to the adjacent section via a fastener through the overlapped portion.

* * * * *